US011109666B2

(12) United States Patent
Belamine

(10) Patent No.: US 11,109,666 B2
(45) Date of Patent: Sep. 7, 2021

(54) ROTARY HEAD TOOTHBRUSH

(71) Applicant: Karim Belamine, Casablanca (MA)

(72) Inventor: Karim Belamine, Casablanca (MA)

( * ) Notice: Subject to any disclaimer, the term of this patent is extended or adjusted under 35 U.S.C. 154(b) by 0 days.

(21) Appl. No.: 15/554,539

(22) PCT Filed: Mar. 7, 2016

(86) PCT No.: PCT/IB2016/051284
§ 371 (c)(1),
(2) Date: Aug. 30, 2017

(87) PCT Pub. No.: WO2016/157008
PCT Pub. Date: Oct. 6, 2016

(65) Prior Publication Data

US 2018/0070714 A1 Mar. 15, 2018

(30) Foreign Application Priority Data

Mar. 31, 2015 (EP) ..... 15161990

(51) Int. Cl.
*A46B 5/00* (2006.01)
*A46B 9/04* (2006.01)
*A46B 7/02* (2006.01)

(52) U.S. Cl.
CPC ..... *A46B 5/0083* (2013.01); *A46B 5/002* (2013.01); *A46B 7/02* (2013.01); *A46B 9/04* (2013.01); *A46B 2200/1066* (2013.01)

(58) Field of Classification Search
CPC ..... A46B 5/0083; A46B 5/0058; A46B 5/002; A46B 7/02; A46B 2200/1066; A46B 5/0075; A46B 9/04
USPC ..... 15/167.1, 185, 172
See application file for complete search history.

(56) References Cited

U.S. PATENT DOCUMENTS 424,716 A * 4/1890 Lichtenstein ..... A46B 5/0075 15/172
2,091,716 A * 8/1937 Petta ..... A46B 7/02 15/144.1
2,625,697 A * 1/1953 Cyser ..... A46B 7/08 15/167.1
2,850,753 A * 9/1958 Pelletier ..... A46B 5/0033 132/311
3,105,259 A * 10/1963 Morrell ..... A46B 5/0033 15/144.1
4,330,896 A * 5/1982 Booth ..... A46B 7/02 15/167.1

(Continued)

FOREIGN PATENT DOCUMENTS

FR 1 569 196 A 5/1969
GB 191 745 A 8/1923

(Continued)

OTHER PUBLICATIONS

International Search Report of PCT/IB2016/051284 dated May 23, 2016 [PCT/ISA/210].

*Primary Examiner* — Laura C Guidotti
*Assistant Examiner* — Thomas Raymond Rodgers
(74) *Attorney, Agent, or Firm* — Sughrue Mion, PLLC

(57) ABSTRACT

A toothbrush having a handle and a head provided with bristles. The head is mounted pivotably with respect to the handle, and the handle has at one end two arms projecting along a longitudinal axis of the handle and defining a space. The head is pivotably mounted in the space defined by the arms.

14 Claims, 6 Drawing Sheets

(56) References Cited

U.S. PATENT DOCUMENTS

| | | | | | |
|---|---|---|---|---|---|
| 4,731,896 | A * | 3/1988 | de La Tour | A46B 5/0075 15/106 |
| 5,442,831 | A * | 8/1995 | Yamada | A46B 5/0075 15/144.1 |
| 5,530,981 | A * | 7/1996 | Chen | A46B 5/0075 15/111 |
| 2007/0277339 | A1 * | 12/2007 | Barsheshet | A46B 7/06 15/167.1 |
| 2018/0186344 | A1 * | 7/2018 | Voelker | B60S 3/045 |

FOREIGN PATENT DOCUMENTS

| | | | | |
|---|---|---|---|---|
| GB | 191745 A | * | 8/1923 | A46B 5/0075 |
| GB | 391 638 A | | 5/1933 | |

* cited by examiner

ROTARY HEAD TOOTHBRUSH

CROSS REFERENCE TO RELATED APPLICATIONS

This application is a National Stage of International Application No. PCT/IB2016/051284, filed Mar. 7, 2016, claiming priority based on European Patent Application No. 15161990.5, filed Mar. 31, 2015, the contents of all of which are incorporated herein by reference in their entirety.

The invention relates to the domain of toothbrushes, and more particularly the domain of toothbrushes with rotary heads.

Broadly speaking, toothbrushes comprise a handle at the end of which a head of elongated shape extends. The head has tufts of bristles for cleaning the teeth, gums and oral mucosa.

However, some areas of the mouth remain difficult to access. This is particularly the case for the palatal face and lingual face of the upper and lower teeth.

In order to be able to have access to the palatal and with lingual areas of the teeth, technical solutions have been proposed. In the document U.S. Pat. No. 2,091,716 (JOHN J. PETTA), described is a toothbrush the head whereof is pivotably mounted with respect to the body between two positions, namely a first position in which the head extends in the prolongation of the handle and a second position in which the head extends perpendicular to the handle.

This toothbrush seems to achieve the objective to which it was assigned. However, it must be noted that it has several disadvantages.

In particular, part of the handle is located in the head when the head of the toothbrush is in first position thereof. Consequently, the recess where the handle is located in the brush head has a width at least equal to the width of the handle. This recess cannot be provided with bristles, which hinders the cleaning performance of the toothbrush and adversely affects the principal function thereof.

In order to resolve the technical problems raised, the invention seeks several objectives, namely to propose a toothbrush:

enabling the palatal and lingual faces of the teeth to be cleaned, while adapting to the morphology of the user, the head whereof would be entirely provided with tufts of bristles, so that the cleaning performance is uniform over the entire surface of the head.

To that end, firstly, a toothbrush is proposed comprising a handle and a head provided with bristles, said head being mounted pivotably with respect to the handle, the handle comprising at one end two arms projecting along a longitudinal axis of the handle and defining a space, the head being pivotably mounted in the space defined by the arms, along an axis perpendicular to the arms and passing through the arms.

Such a toothbrush makes it possible to clean the palatal and lingual faces of the teeth, while adapting to the morphology of the user, Moreover, the head is entirely provided with tufts of bristles, so that the cleaning performance is uniform over the whole surface of the head.

Various additional characteristics can be foreseen, alone or in combination:

the head is provided with a base comprising a hole passing therethrough;

each arm comprises a perforation;

the head is pivotably mounted on the arms by means of a pin inserted through one of the two perforations, said pin passing through the base and entering the other perforation;

the handle comprises a button integral with a rigid rod;

the rod extends inside the handle up to one end of the handle;

the button comprises two positions, namely a blocked position in which the rod extends projecting into the space defined by the arms, along a longitudinal axis, the rod being partially inserted into a notch made on the front face of the base, and an unblocked position in which the rod is retracted and does not extend into the space defined by the arms;

a distance d1 corresponding to the distance separating a front face of the base and the center of the perforations is less than a distance d3 separating an internal wall of the handle and the center of the perforations;

a distance d2 corresponding to the distance separating a rear face of the base and the center of the perforations is less than a distance d3 separating an internal wall of the handle and the center of the perforations.

Other characteristics and advantages of the invention will be seen more clearly and specifically from the following description of embodiments, which is provided with reference to the appended drawings in which.

Figure 1:
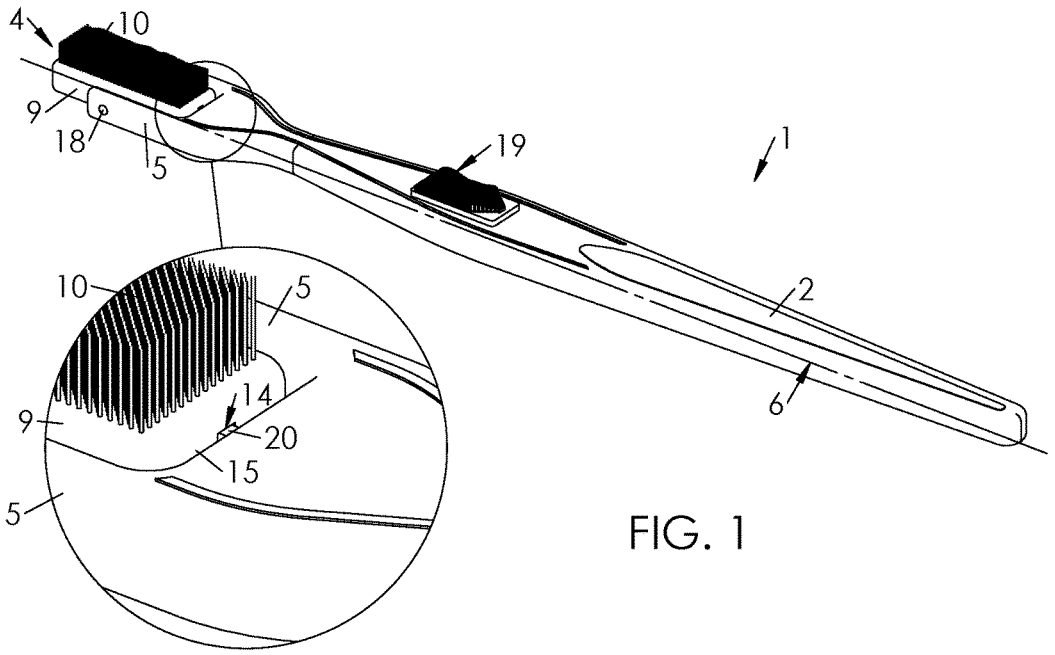
FIG. 1 is a view in perspective of a toothbrush.
Figure 2:
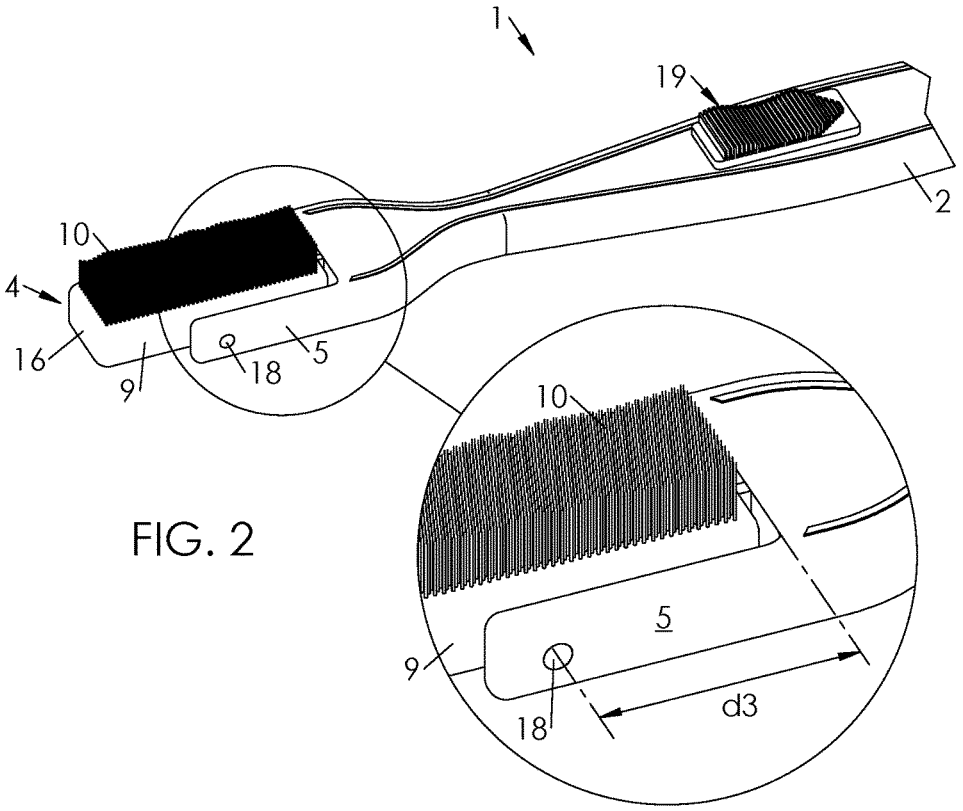
FIG. 2 is a close up view in perspective of the toothbrush of FIG. 1, with a detailed view in inset.
Figure 3:
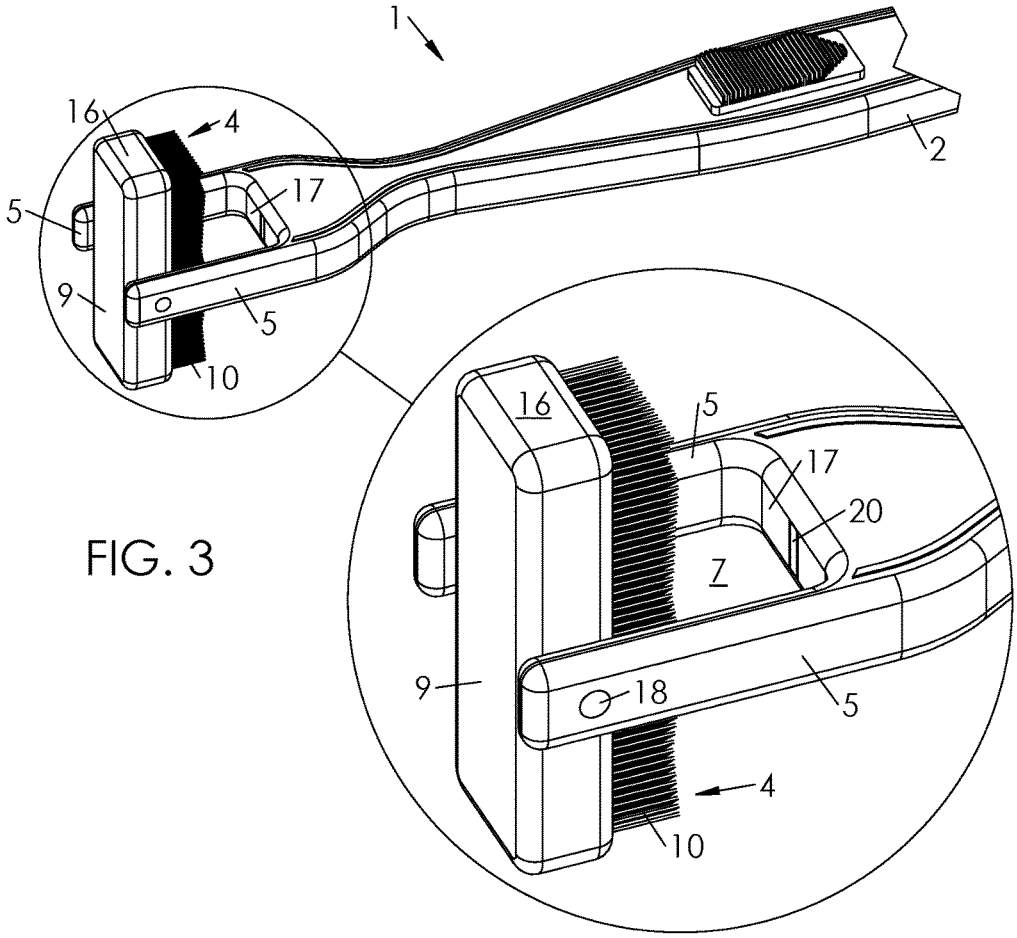
FIG. 3 is a view in perspective showing the toothbrush according to a particular use with a detailed view in an inset.

Represented in FIG. 1 is a toothbrush 1 comprising a handle 2 on which is mounted, at one end 3, a head 4.

Figure 4:
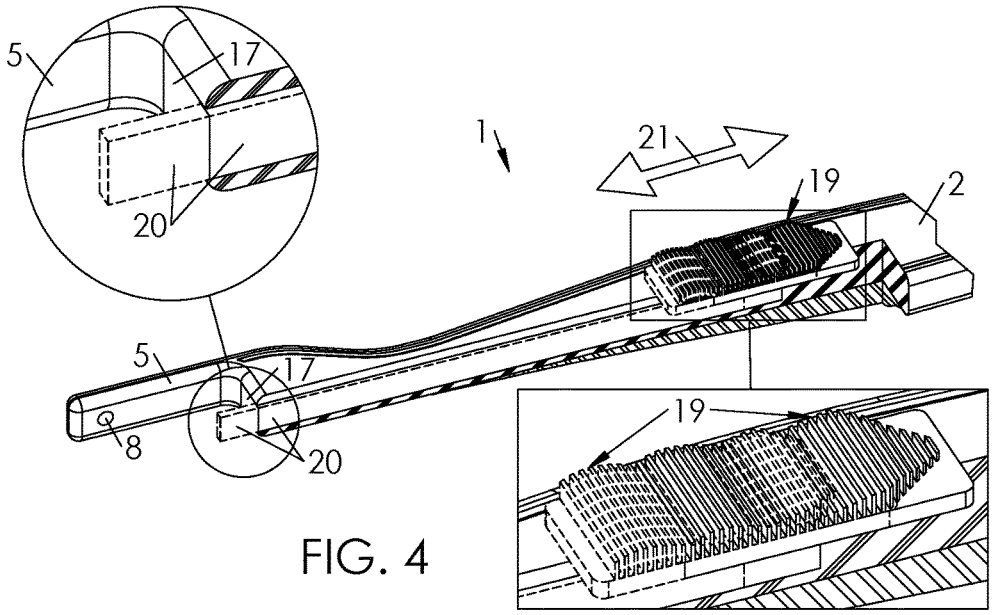
FIG. 4 is a view in perspective representing the operation of the toothbrush of the preceding figures.
Figure 5:
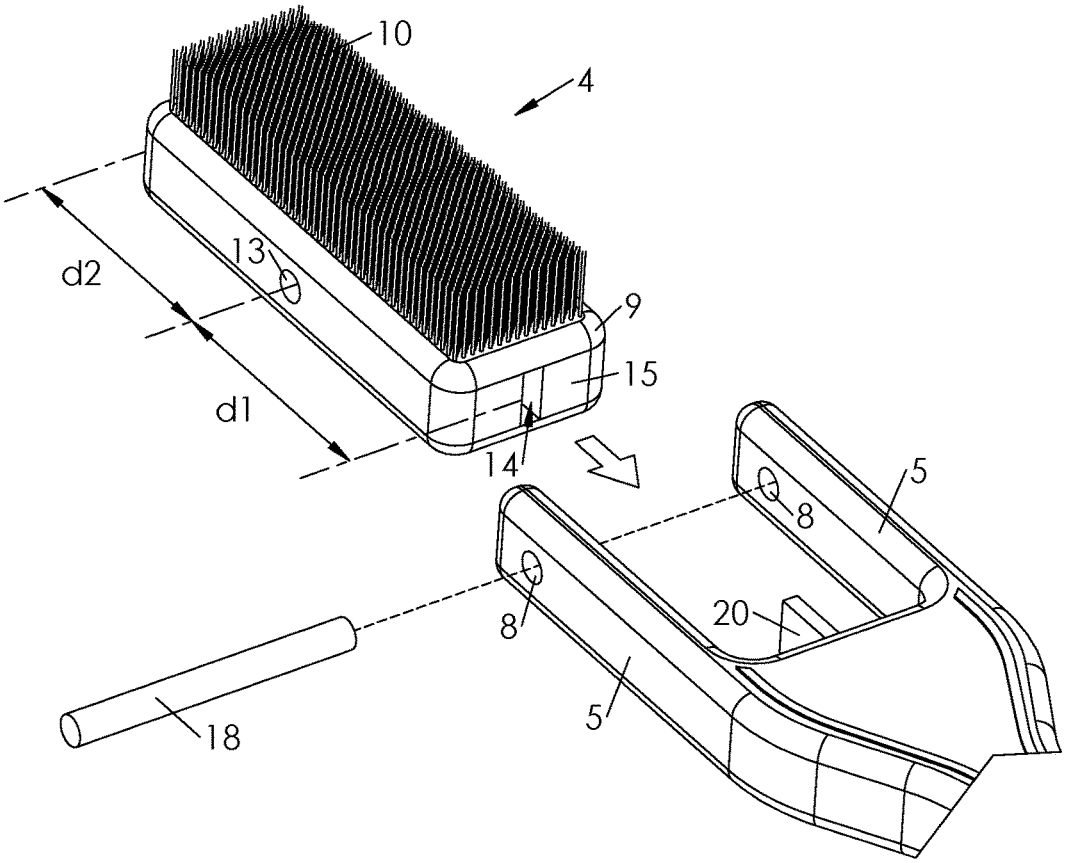
FIG. 5 is an exploded view of the toothbrush.

The end 3 is represented in greater detail in FIG. 4. The end 3 comprises two arms 5 projecting along a longitudinal axis 6 of the handle 2. The arms 5 define a space 7 between them. Each arm 5 comprises a perforation 8. The perforations 8 face each other.

The head 4 is substantially rectangular in shape. Said head is provided with a base 9 on which tufts 10 bristles are attached. The tufts 10 are intended to come into contact with the teeth 11 and oral mucosa 12 of a user.

The base 9 comprises a hole 13 passing therethrough. The hole 13 is of circular cross-section. The base 9 also comprises a notch 14 situated on a front face 15.

The head 4 is mounted on the handle 2 by positioning it in the space 7 in such a way that the hole 13 is facing the perforations 8. A pin 18 is then inserted through one of the two perforations 8 and through the base 9 until it enters the other perforation 8.

The head 4 is then mounted pivotably with respect to the handle 2. Said head can pivot 360°, and can therefore make one complete turn. In order for the head 4 to be able to pivot, it is necessary that a distance d1 and a distance d2 corresponding respectively to the distance between the front face 15 and the center (not shown) of the perforations 8 and the distance between a rear face 16 and the center of the perforations 8 is less than a distance d3 separating an internal wall 17 of the handle 2 and the center of the perforations 8.

The handle 2 comprises a button 19 integral with a rigid rod 20. The rod 20 extends inside the handle 2 from the button 19 up to the end 3. The rod 20 is moved in accordance with the movement of the button 19. The button 19 comprises two positions, a blocked position in which the rod 20 extends projecting into the space 7 along the longitudinal axis 6 of the handle 2 and an unblocked position in which the rod 20 is retracted and does not extend into the space 7. The kinetics of movement of the button 19 are represented in FIG. 4.

The button 19 and the rod 20 enable the rotation of the head 4 to be blocked. To that end, the head 4 is positioned in such a way that the notch 14 situated on the base 9 is facing the rod 20, then the button 19 is moved according to the arrow 21. The rod 20 then enters the notch 14, thus blocking the rotation of the head.

Figure 6:
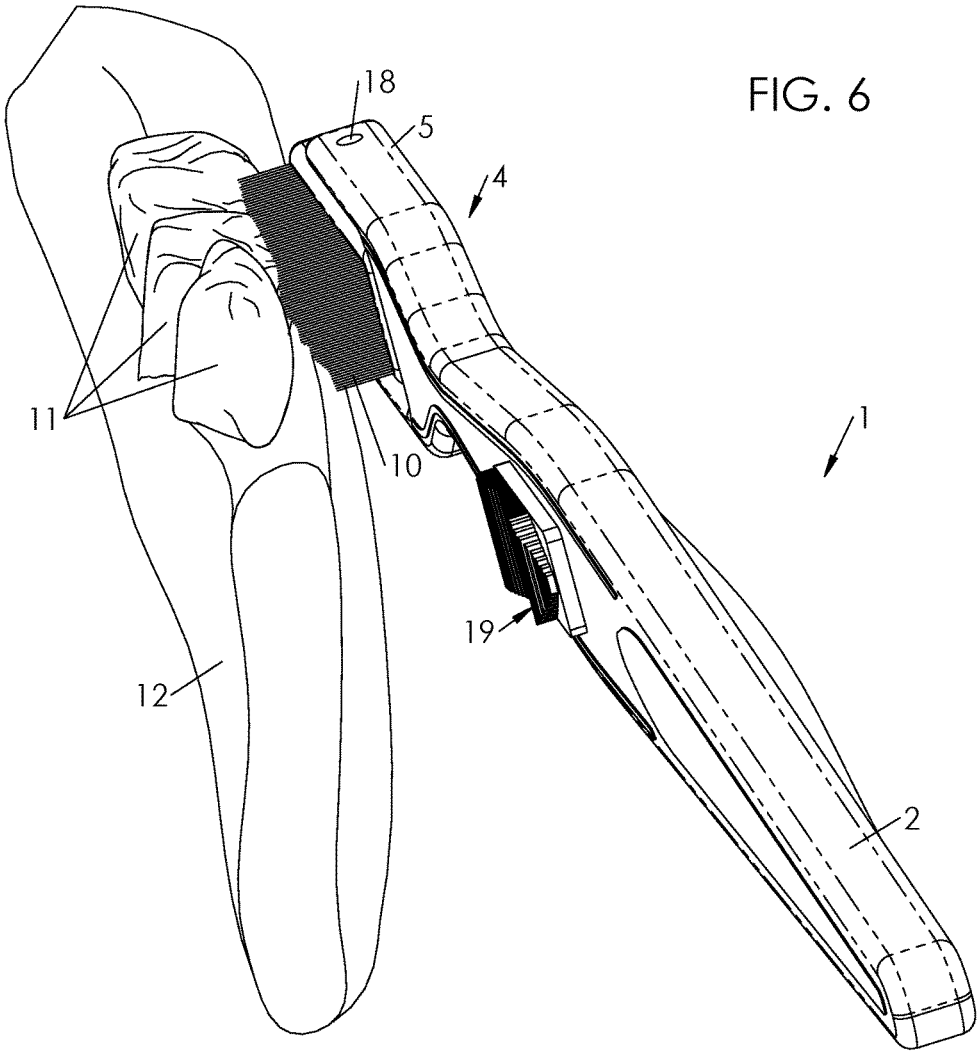
FIG. 6 is a view in perspective of the use of the toothbrush.
Figure 7:
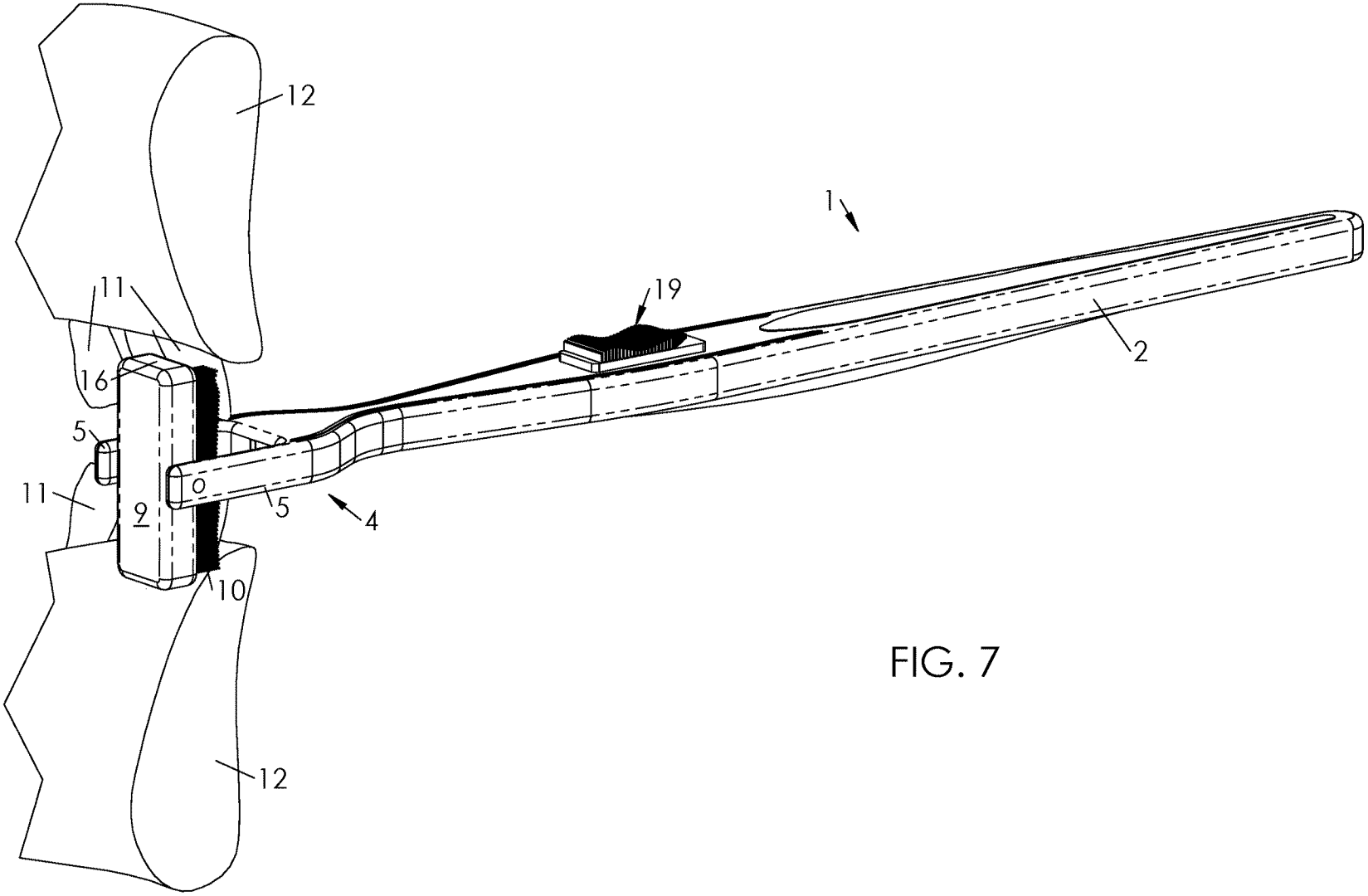
FIG. 7 is a view in perspective of another use of the toothbrush.
Figure 8:
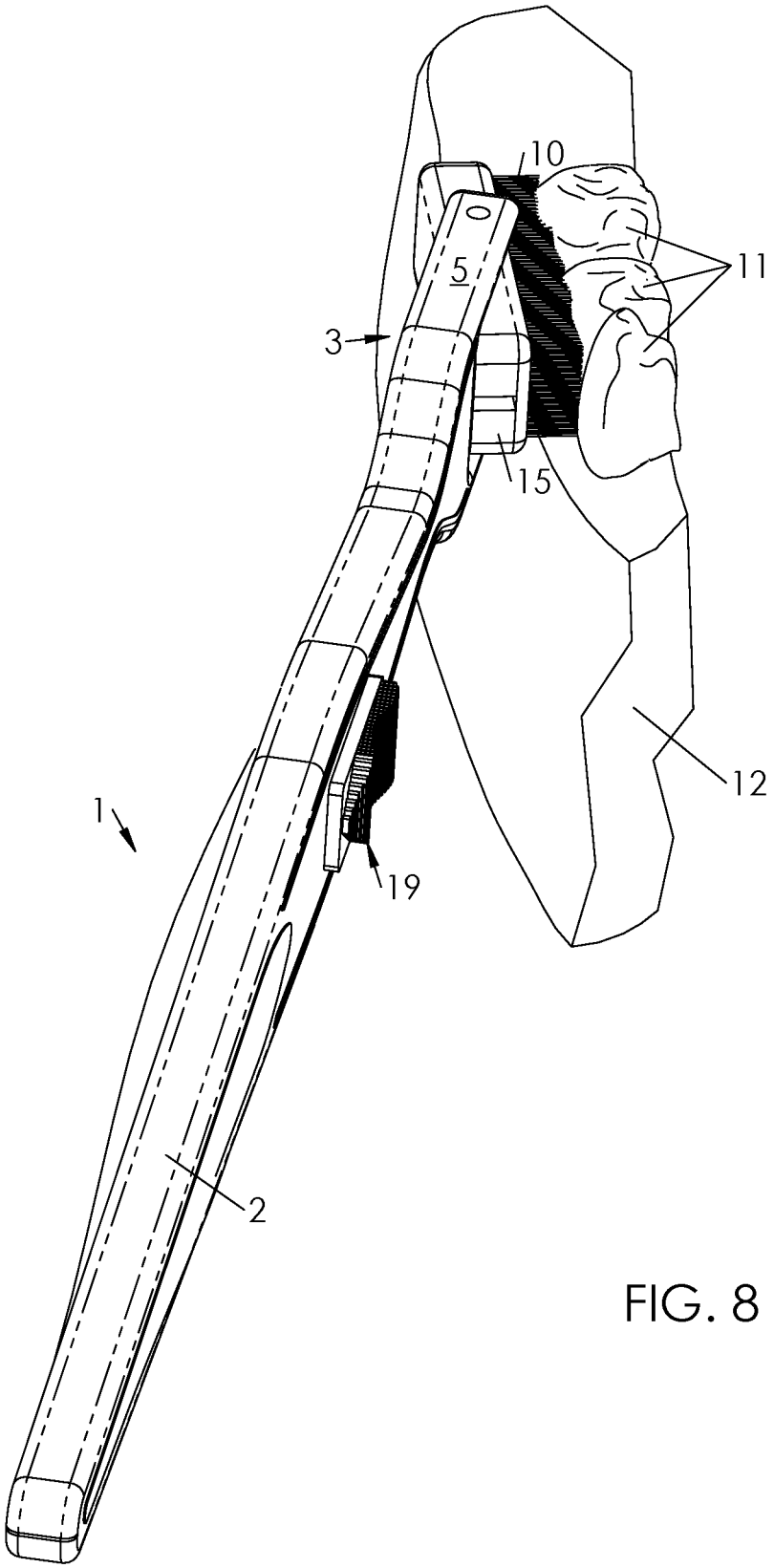
FIG. 8 is a view in perspective of another use of the toothbrush.

Such a toothbrush 1 can then be used both when the head 4 is blocked as well as when it is free to pivot. When the head 4 is free to pivot, the user can easily clean the palatal and lingual faces of the teeth as shown in FIG. 6. The toothbrush 1 can then be adapted to the morphology of the user, as a result of the pivoting of the head 4 with respect to the handle, as represented in FIG. 8.

In a second embodiment, the rotation of the head 4 has a slight resistance. In other words, the user must apply a certain force in order to pivot the head 4 around a pin 18.

The invention claimed is:

1. A toothbrush comprising a handle and a head provided with bristles, said head being mounted pivotably with respect to the handle, the handle comprises at one end two arms projecting along a longitudinal axis of the handle and defining a space, the head being mounted pivotably in the space defined by the arms, along an axis perpendicular to the arms and passing through the arms;

the handle comprises a button integral with a rigid rod extending inside the handle up to one end thereof, the button comprising two positions, namely a blocked position in which the rod extends projecting into the space defined by the arms along a longitudinal axis, the rod being partially inserted into a notch made on a front face of a base of the head, and an unblocked position in which the rod is retracted and does not extend into the space defined by the arms; in the unblocked position the head is free to pivot 360° so as to enable a user of the toothbrush to access palatal and lingual faces of the teeth; and wherein the button remains in the blocked position until the user actuates the button to the unblocked position and wherein, when the button is in the unblocked position, the button remains in the unblocked position without user interference and until the user actuates the button to the blocked position.

2. The toothbrush according to claim 1, wherein the base of the head comprises a hole passing therethrough.

3. The toothbrush according to claim 2, wherein each arm comprises a perforation.

4. The toothbrush according to claim 3, wherein the head is mounted pivotably on the arms by means of a pin inserted through one of the two perforations, said pin passing through the base and entering the other perforation.

5. The toothbrush according to claim 3 wherein a distance corresponding to the distance separating a front face of the base and the center of the perforations is less than a distance separating an internal wall of the handle and the center of the perforations.

6. The toothbrush according claim 5 wherein a distance corresponding to the distance separating a rear face of the base and the center of the perforations is less than a distance separating an internal wall of the handle and the center of the perforations.

7. The toothbrush according to claim 1, wherein the rigid rod extends in a direction parallel to a longitudinal direction of the handle.

8. The toothbrush according to claim 1, wherein the rigid rod extends in a direction parallel to a longitudinal direction of the two arms.

9. The toothbrush according to claim 1, wherein the head comprising bristles and the head is mounted pivotably in the space defined by the two arms so that bristles attached to the head can pass in the space defined by the two arms.

10. The toothbrush according to claim 1, wherein the button is located on the handle so as to remain outside the user's mouth and accessible by the user of the toothbrush while accessing the palatal and lingual faces of the teeth.

11. The toothbrush according to claim 1, wherein the button is configured to be left in the unblocked position to allow the head to freely pivot 360° while the user accesses the palatal and lingual faces of the teeth.

12. A toothbrush comprising:

a handle;

two arms extending from the handle at one end of the handle; and a head;

the head comprising bristles;

the head pivotably mounted to the two arms and having a locked position and an unlocked position, wherein in the locked position, the head is oriented parallel to a longitudinal axis of the two arms and locked against rotation and in the unlocked position the head freely rotates between the two arms;

wherein the head remains in the unlocked position without user interference, allowing the head to rotate 360 degrees, until a user locks the head to place the head in the locked position, and wherein the head remains in the locked position until a user unlocks the head to place the head in the unlocked position wherein in the locked position, a projection extending from the handle between the two arms is engaged with a recess in an end portion of the head to lock the head against rotation.

13. The toothbrush according to claim 12, wherein the two arms and the handle extend in a common plane to form a straight toothbrush.

14. The toothbrush according to claim 12, wherein in the locked position, the head, the two arms and the handle are aligned to form a straight toothbrush.

* * * * *